US005404609A

United States Patent [19]

Rench et al.

[11] Patent Number: 5,404,609

[45] Date of Patent: Apr. 11, 1995

[54] CARPET CLEANING MACHINE WITH ENHANCED USER FEATURES

[75] Inventors: Geoffrey B. Rench, Racine, Wis.; Frank Jolly, Arcata, Calif.; David R. Sheppard, Racine, Wis.

[73] Assignee: Racine Industries, Inc., Racine, Wis.

[21] Appl. No.: 140,402

[22] Filed: Oct. 25, 1993

[51] Int. Cl.[6] ..... A47L 5/30; A47L 9/32; A47L 11/18; A47L 11/32

[52] U.S. Cl. ..... 15/52.1; 15/144.1; 15/179; 15/350; 15/384; 15/410

[58] Field of Search ..... 15/49.1, 50.1, 50.2, 15/50.3, 52.1, 52.2, 144.1, 98, 320, 340.3, 340.4, 350, 351, 179, 383, 384, 388, 392, 410, 411, 361

[56] References Cited

U.S. PATENT DOCUMENTS

| | | | |
|---|---|---|---|
| 1,417,768 | 5/1922 | Radimak | 15/384 X |
| 1,588,157 | 6/1926 | Beach | 15/52.1 |
| 2,842,788 | 7/1958 | Rench et al. | 15/52.1 |
| 3,061,859 | 11/1962 | Dubay | 15/50.3 |
| 3,220,043 | 11/1965 | Lampe | 15/52.1 |
| 3,755,843 | 9/1973 | Goertzen, III et al. | 15/350 |
| 5,086,539 | 2/1992 | Rench | 15/384 |

FOREIGN PATENT DOCUMENTS

| | | | |
|---|---|---|---|
| 821673 | 8/1927 | France | 15/52.1 |
| 654006 | 12/1937 | Germany | 15/52.1 |
| 464098 | 4/1937 | United Kingdom | 15/52.1 |
| 957659 | 5/1964 | United Kingdom | 15/49.1 |

*Primary Examiner*—Edward L. Roberts, Jr.
*Attorney, Agent, or Firm*—Jansson & Shupe, Ltd.

[57] ABSTRACT

Disclosed are new features relating to a brush-supported carpet cleaning machine of the type having counter-revolving brushes. Such features include a new handle mounting and latching arrangement which simplifies handle mounting and de-mounting, which helps support the weight of a handle-mounted vacuum pod and which promotes a high degree of machine self-propulsion. The pod is attached to the machine handle by a novel gudgeon-and-pintle mechanism. Such features also include a new support device, preferably brush-mounted, which helps prevent the machine shroud from snagging carpet if the machine should "wallow" or "yaw" in operation.

19 Claims, 11 Drawing Sheets

FIG. 1
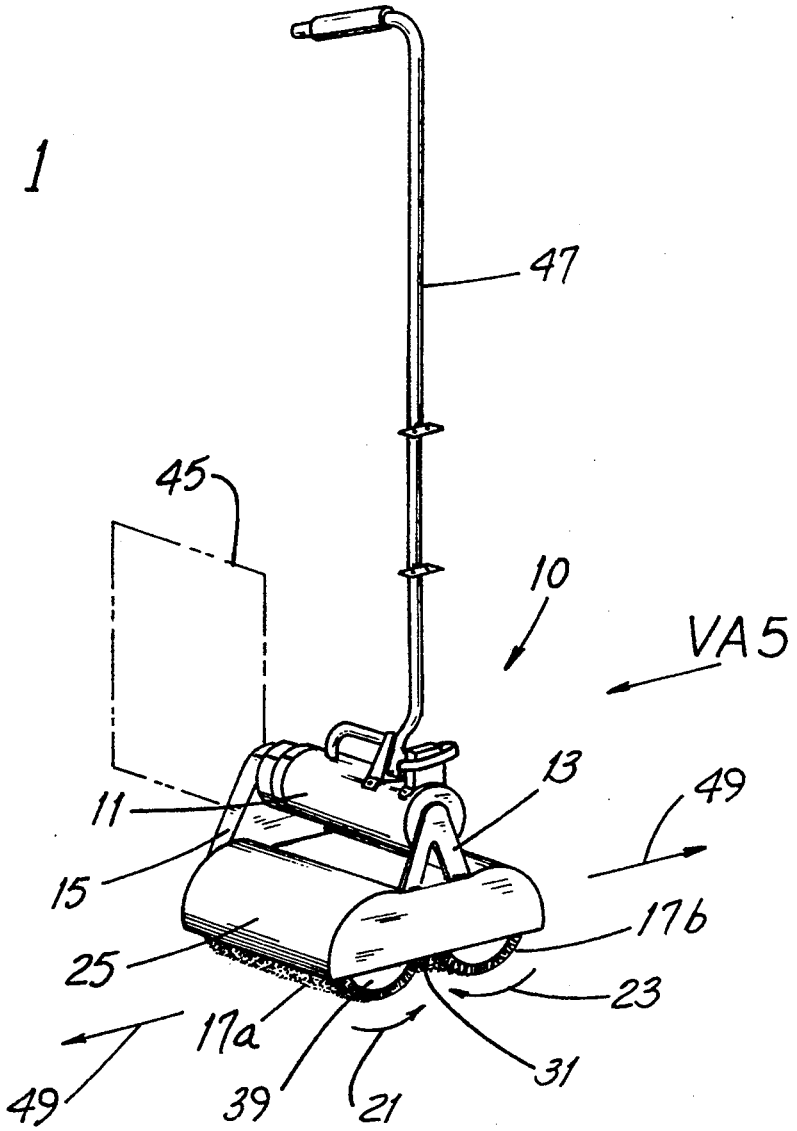
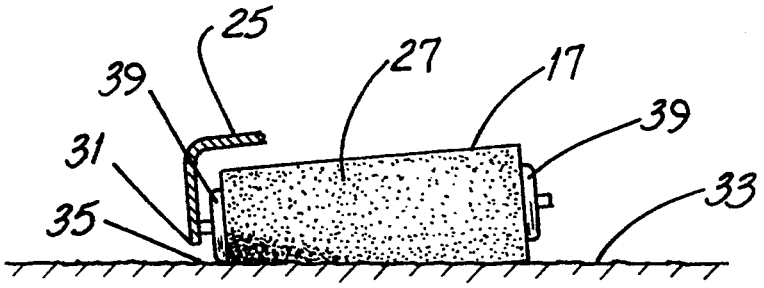
FIG. 4

6 6

CARPET CLEANING MACHINE WITH ENHANCED USER FEATURES

FIELD OF THE INVENTION

The invention relates generally to cleaning and, more particularly, to carpet cleaning.

BACKGROUND OF THE INVENTION

The three primary approaches used to clean commercial and residential carpets are steam or hot water, foam and dry systems. Dry-type carpet cleaning systems are further divided into two broad categories. One uses a dry or substantially dry powder and the other uses granules, each of which is several times larger than a powder grain. The granules are slightly moistened with cleaning solvents for dirt removal. The inventive machine has utility for both categories of dry systems cleaning solvents for dirt removal. The inventive machine has utility for both categories of dry systems but relates primarily to those using granules rather than powder. Such machine also has utility in situations where only carpet vacuuming is performed. That is, its long-bristled brushes are highly effective in removing loose sand and other soil not requiring the application of solvent-bearing material.

Of the dry granular carpet cleaning systems, the best known and most widely used is the HOST® dry extraction system offered by Racine Industries, Inc. of Racine, Wis. The HOST® system applies granules to carpet fibers using a machine as shown in Rench et al. U.S. Pat. Nos. 2,842,788 and 2,961,673. Such machine, sold under the HOST® trademark, is devoid of vacuum capability and has a pair of spaced brushes counter-rotating at relatively low speed (about 350 rpm) to stroke the cleaning granules into, through and across the carpet and its fibers.

The granules are referred to as "dry" and are substantially so even though moistened with cleaning solvents. When stroked as described, these granules "scrub" dirt and soil from such fibers including oily and non-oily soil. The carpet is cleaned by working the HOST® machine across it in different directions and during such cleaning process, granules migrate to the carpet backing adjacent to the base of the fiber. A few granules also adhere lightly to the fibers along their lengths. Heretofore, conventional carpet vacuum machines have been used for removing these dirt-ladened granules.

S. C. Johnson Co. of Racine, Wis. sells a vacuum cleaning machine known as VECTRON TM. The machine can be used for hand vacuuming using a wand. However, one must take the entire machine to the site to do so. It is believed that such machine is based upon one or both of the following U.S. Pat. Nos. 5,643,748; 4,853,008 (Dyson).

The invention involves improvements in the HOST® machine depicted in the aforementioned Rench et al. patents and in updated versions of such machine. However, after analyzing this specification, it will be apparent as to how other carpet cleaning machines can benefit from such improvements.

A feature of the known HOST® machine is that the handle (which usually requires two hands to attach and detach) can be latched in an upright position. Such handle is free to "articulate" or swing continuously through an arc of about 180° after the latch is released. While such handle arrangement has been highly satisfactory, it does require that the operator be the motive force urging the machine (with its counter-revolving brushes) forward and rearward as the carpet is brushed clean by the HOST® granules. In other words, the known handle arrangement permits little, if any, degree of self-propulsion as set forth in the detailed description of the invention.

Another aspect of the known HOST® machine is that when it is equipped with a removable, handle-mounted vacuum pod (an innovation mentioned in greater detail below), the operator is required to support the weight of such pod when grasping the handle during machine use. This is tiring and requires additional effort made unnecessary by the invention. And in some types of carpet cleaning machines (e.g., the VECTRON TM machine mentioned above which brushes a dry powder into the carpet and then remove such powder by vacuuming) the vacuum unit is not separable from the machine.

The HOST® machine is available with four different brushes having varying degrees of bristle rigidity, namely, stiff, standard, moderately soft and soft. Soft brushes are for use on Saxony, Plush and Berber style carpets which are more often installed in residences rather than in commercial applications. When equipped with brushes having soft bristles, the bristles often bend excessively and the machine tends to "wallow," "yaw" or "skew." That is, it tilts generally sideways in some undesirable attitude as the machine is manipulated.

This can cause an edge of the shroud (which is positioned above the brushes) to catch or snag on the carpet and the carpet may thereby be damaged. And when the machine is pushed forward or pulled rearward too rapidly or when the handle is "torqued" (twisted about its long axis), the soft bristle brush can partially collapse. When a vacuum pod is mounted on the handle, the extra weight can cause machine wallowing when using either the soft or moderately soft brushes.

In the known HOST® machine, the "free swinging" handle arrangement makes it difficult for the machine operator to most effectively manipulate the machine angularly or laterally back and forth across the carpet. Such manipulation is sometimes desired or even required when making several passes over a more dirt-laden portion of such carpet.

Improvements overcoming the aforementioned disadvantages would be important advances in the art.

OBJECTS OF THE INVENTION

It is an object of the invention to provide improvements overcoming some of the problems and shortcomings of the prior art.

Another object of the invention is to provide an improvement whereby a carpet cleaning machine handle is very easy to attach and detach.

Another object of the invention is to provide an improvement permitting a high degree of machine self-propulsion.

Still another object of the invention is to provide an improvement aiding in supporting a handle-mounted vacuum pod.

Another object of the invention is to provide an improvement whereby a handle-mounted vacuum pod is easily mounted and removed.

Yet another object of the invention is to provide an improvement which aids more aggressive manipulation of a carpet cleaning machine.

Another object of the invention is to provide an improvement for preventing a carpet cleaning machine from snagging on carpet. How these and other objects are accomplished will become more apparent from the following descriptions and from the drawing.

SUMMARY OF THE INVENTION

Aspects of the invention involve an improvement in a generally cylindrical carpet brush mounted in pairs (identified as first and second brushes) on a machine for cleaning carpet. Such brushes are disposed beneath a machine shroud and the machine is worked to and fro, often rather aggressively, by handle manipulation.

The improvement in the brush, which has bristles and a pair of brush ends, comprises a support member mounted at each end of the brush and contacting the carpet when bristles bend during machine use. As described in more detail below, this helps prevent the machine shroud from contacting and snagging on carpet fiber.

A highly preferred support member is generally disc-shaped and with a brush having a first diameter, the support member has a second diameter less than the first diameter. The second diameter is between about 70% and 95% of the first diameter and, more preferably, is between about 75% and 85% of the first diameter. Each support member is mounted on an end of the brush generally concentric to the brush axis of rotation and in the preferred arrangement, rotates with and at the same speed as the brush.

Further, each support member has an outward portion, i.e., the outer circumferential edge. Such outward portion is rounded to remove the "sharpness" of such edge and help prevent carpet thread cutting when the support member contacts the carpet.

In another aspect of the invention and in contemplation of operation from either side of the machine and in either direction of machine travel, it is preferred that a support member is mounted at each end of each brush. Thus, at least one support member contacts the carpet when bristles bend during machine use, irrespective of the direction of machine tipping or travel.

The machine further includes a handle mounting bracket having a tube-like member. A handle assembly is attached to the machine by a laterally-projecting mounting stud received telescope-fashion in the tube-like member. The stud includes a circumferential retention groove and the tube-like member includes a button-like retention device engaging the groove and retaining the assembly on the bracket.

The invention also addresses the need for partial machine disassembly for easier transporting or the like. The stud also includes a longitudinal slot and the stud can be withdrawn from the tube-like member when the slot is aligned with the retention device. In a highly preferred arrangement, the stud includes a pair of slots spaced circumferentially about 180° apart. The stud can be withdrawn from the tube-like member when either slot is aligned with the device as when the handle is placed in either of two withdrawal positions, each about 90° either side of the handle vertical center position.

In yet another aspect, the lower end of the machine handle assembly has an arc-shaped latching segment with at least one notch formed in it. A latching bar is mounted on the machine for pivoting movement up and down into and out of engagement with the notch so that the handle assembly is latched in a position when the bar engages the notch.

As an alternate or additional way to retain the handle assembly on the bracket (and, more specifically, to retain the stud in the tube-like member), the latching bar includes a retention plate overlapping the latching segment when the handle bar is latched at a position, whereby the handle assembly is retained on the machine.

More specifically, the handle assembly has an elongate handle bar with the latching segment at its lower end and with a gripping handle at its upper end. The latching segment has a pivot center, a lower edge and a plurality of angularly spaced-apart notches formed along the edge. The handle bar is latched at a different angular position (with respect to, e.g., the carpet surface or to a horizontal plane) for each engagement of the latching bar with a different notch.

A highly preferred machine also includes a separately-powered vacuum "pod" so that the machine can retrieve dirt-laden granules after such granules have been brushed through the carpet to clean the carpet strands, all as described in more detail below. The vacuum pod is detachably connected to the handle bar, preferably by a gudgeon-and-pintle mechanism, i.e., a mechanism having one or more pinkie-like pins engaging one or more gudgeon-like holes.

In a specific arrangement, the handle bar has a plurality of gudgeon-like supports mounted thereon with holes through the supports to receive pins. The vacuum pod has a plurality of pintie-like pins and a separate pin engages each of the supports.

And there are a number of choices for machine configuration. As described below, the machine can be arranged without brush support members and/or a vacuum pod. That is, the machine may be equipped only with the improvements involving the handle mounting bracket and the handle assembly as mentioned. Other details of the invention are set forth in the following detailed description and in the drawing.

BRIEF DESCRIPTION OF THE DRAWING

FIG. 1 is a perspective view of a carpet cleaning machine showing aspects of the inventive improvements. A vertical reference plane is shown in dashed outline.

FIG. 4 is a representative view showing a carpet cleaning brush (like that of FIGS. 2 and 3) in a partially collapsed state. The brush is shown in conjunction with a portion of the machine shroud.

DETAILED DESCRIPTION OF PREFERRED EMBODIMENTS

Figure 2:
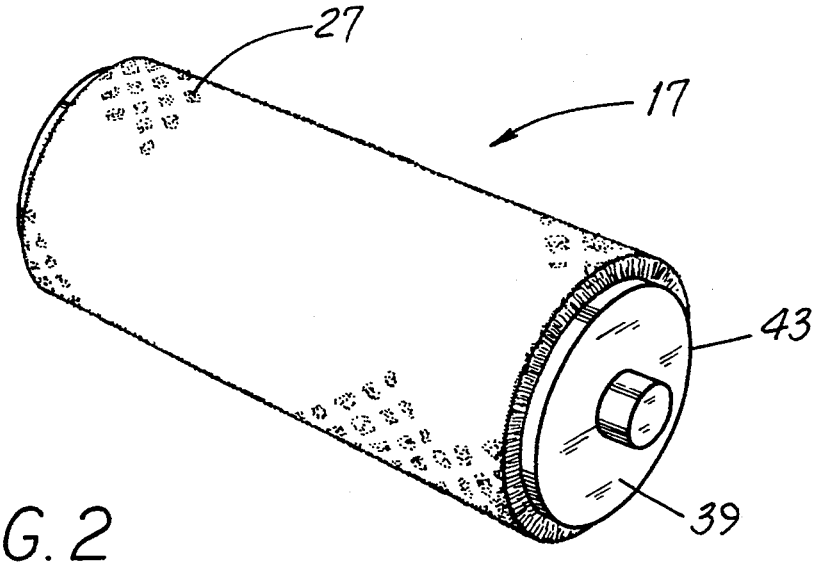
FIG. 2 is a perspective view of a cleaning brush of the machine of FIG. 1.

FIG. 1 depicts a carpet cleaning machine 10 having an electric drive motor 11, a motor support 13 and a gear box 15 connecting the motor 11 to first and second counter-revolving brushes 17*a* and 17*b*, respectively. Rotation of a brush 17 is in the direction indicated by the arrow 21 or 23, respectively. The machine 10 is entirely supported on the brushes 17 which, as described above, stroke cleaning granules across and along the carpet fibers as the machine 10 is "worked" across the carpet. A molded shroud 25 is spaced slightly above the brushes 17 and, among other functions, helps retain cleaning granules at the site where the brushes 17 contact the carpet.

Figure 6:
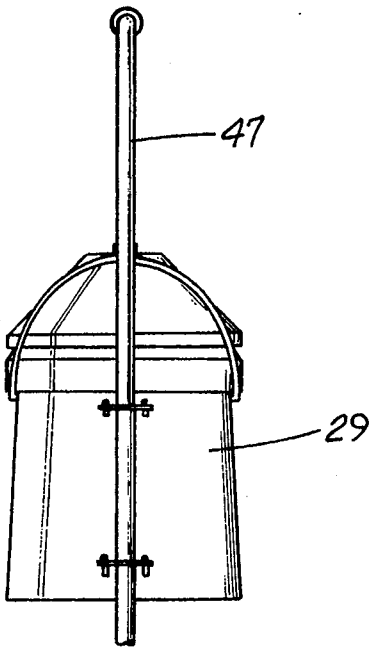
FIG. 6 is an elevation view of a portion of the machine of FIG. 5 taken along the viewing plane 6—6 thereof. Parts are broken away.
Figure 5:
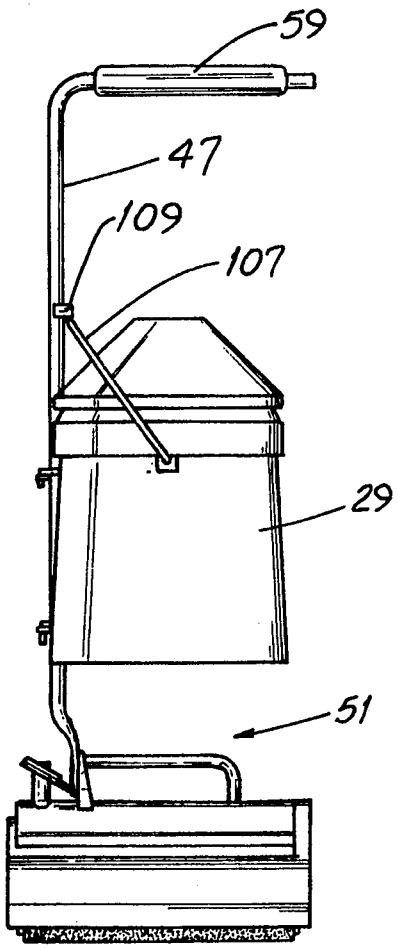
FIG. 5 is an elevation view of the machine of FIG. 1 taken generally along the viewing axis VA5 thereof and including a mounted vacuum pod.

Referring also to FIGS. 2, 3, 4 and 5 it has been found that in certain operating circumstances and when the machine 10 is equipped with soft or moderately soft brushes 17, the bristles 27 bend excessively and the machine 10 tends to wallow or tilt as shown in FIG. 4. Such wallowing or tilting is more apt to occur when a vacuum pod 29 (with its extra weight) is mounted on the machine 10 as shown in FIGS. 5 and 6. As a result, a lateral edge 31 of the machine shroud 25 can snag on the carpet and even cut carpet fiber 35.

An aspect of the invention involve an improvement in the brush 17, which has bristles 27 and a pair of brush ends 37*a*, 37*b*. The improvement comprises a rigid support member 39 mounted at each end 37 of the brush 17 and contacting the carpet 33 when bristles 27 bend during machine use. The support member 39 thus helps prevent the machine shroud 25 from contacting and snagging on carpet fiber 35.

A highly preferred support member 39 is generally disc-shaped and with a brush 17 having a first diameter D1, the support member 39 has a second diameter D2 less than the first diameter D1. The second diameter D2 is between about 70% and 95% of the first diameter D1 and, more preferably, is between about 75% and 85% of the first diameter D1. Each support member 39 is mounted on an end 37 of the brush 17 generally concentric to the brush axis of rotation 41 and in the preferred arrangement, rotates with and at the same speed as the brush 17.

As an example, a known type of soft-bristled brush 17 suitable for use with the HOST TM machine has tufts of Tynex brand type 6.6 nylon bristles with a bristle diameter of about 0.008–0.009 inches. The brush. diameter is about 4.87 inches and the diameter of an exemplary support member 39 is in the range of about 4.0 to 4.06 inches.

Figure 3:
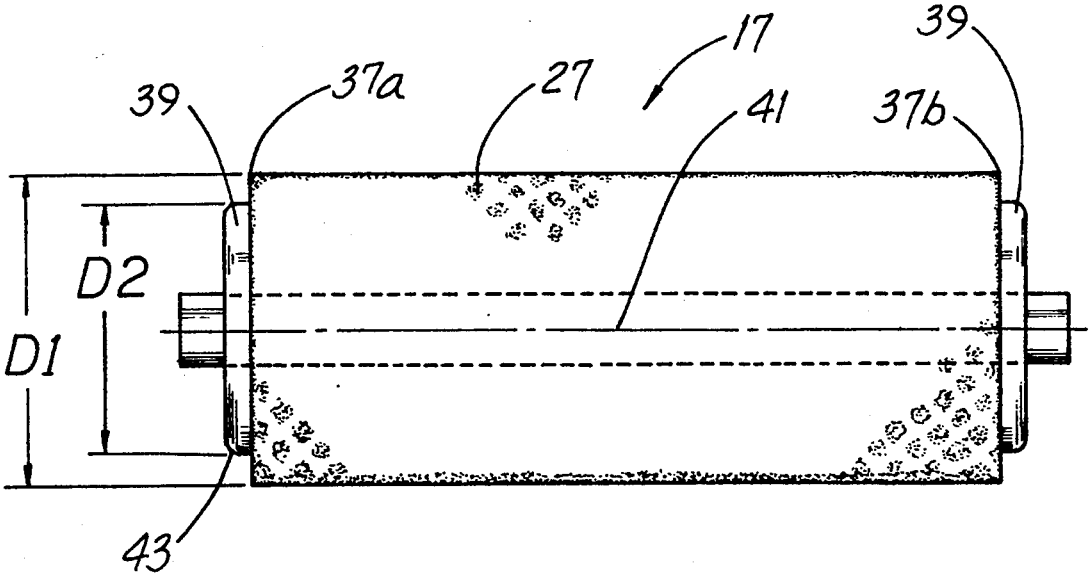
FIG. 3 is an elevation view of the brush of FIG. 2.

Further, each support member 39 has an outward portion, i.e., the outer circumferential edge 43. Such edge 43 may be formed to have a 90° corner as shown in FIG. 2. However, a preferred edge 43 is chamfered or rounded as shown in FIG. 3 to remove the "sharpness" of such edge 43 and help prevent carpet fiber snagging when the support member 39 contacts the carpet 33.

Referring again to FIG. 1, it will be observed that the machine 10 is substantially symmetrical about a vertical plane 45 through the handle bar 47 and parallel to the brush axes of rotation 41. The machine 10 can be operated with the handle bar 47 tilted to either side of such plane 45, i.e., with the operator to the left or to the right of the machine 10 (as seen in FIG. 1) and facing the machine 10. And the machine 10 can be urged in either of two directions (as indicated by the arrows 49) normal to the axes 41 of brush rotation.

Because of the aforedescribed machine symmetry and because the operator may manipulate the machine 10 from either the front or the rear, brush bristles 27 can partially collapse at either the left or the right side of the machine 10, depending upon how such machine 10 is being "urged" by the operator. Therefore, it is preferred that a support member 39 is mounted at each end 37 of each brush 17. Thus, at least one support member 39 contacts the carpet 33 when bristles 27 bend excessively during machine use, irrespective of the direction of machine tipping and irrespective of whether the operator is at the machine front or rear. (Because of machine symmetry, "forward" and "rearward" are from the perspective of the machine operator—the front of the machine 10 is away from the operator and the rear is toward such operator.)

Aspects of the invention contemplate the need to quickly assemble or disassemble the machine 10 and the further need to be sure the machine 10 remains properly assembled during rigorous use. Referring also to FIGS. 7–10 and in another aspect of the invention, the machine 10 further includes a handle mounting bracket 51 having an L-shaped tube-like member 53, one end of which is attached to a bracket support 55. A generally L-shaped handle assembly 57 has a laterally-extending gripping handle 59, a downwardly extending handle bar 47 attached to the handle 59 and an arc-shaped latching segment 61 at the lower end of the bar 47.

A generally cylindrical mounting stud 63 is attached to and projects laterally from the latching segment 61 and has a diameter selected so that the stud 63 may be received telescope-fashion (with slight sliding clearance) in an opening 65 in the member 53. The member 53 includes a rounded, button-like retention device 67 projecting upward into the opening 65 and the stud 63 has at least one (and preferably two) longitudinal slots 69 formed along the stud length. The stud 63 is inserted into or removed from the member 53 by aligning either slot 69 with the device 67 and pressing the stud 63 inward or outward, as the case may be.

In a highly preferred arrangement, the slots 69 are spaced circumferentially on the stud 63 and preferred spacing is about 180° apart. Thus, the stud 63 can be inserted into or withdrawn from the tube-like member 53 when (and only when) either slot 69 is aligned with the device 67 as when the handle bar 47 is placed in a position about 90° either side of the handle vertical center position which is shown in FIG. 1. And withdrawal to detach the handle assembly 57 is very easy—one need only grasp the segment 61 with one hand and press against the bracket 51 with the thumb of that hand to separate the assembly 57 from the machine 10 for transporting or the like.

The stud 63 includes a circumferential retention groove 71 which is aligned with the device 67 when the stud 63 is fully inserted into the member 53 and the segment 61 is closely adjacent to the bracket 51. The device 61 continuously engages the groove 71 for any angular position of the handle assembly 57 and retains the assembly 57 on the bracket 51. The description below which relates to FIGS. 15–17 sets forth other ways to retain the assembly 57 on the bracket 51.

Figure 7:
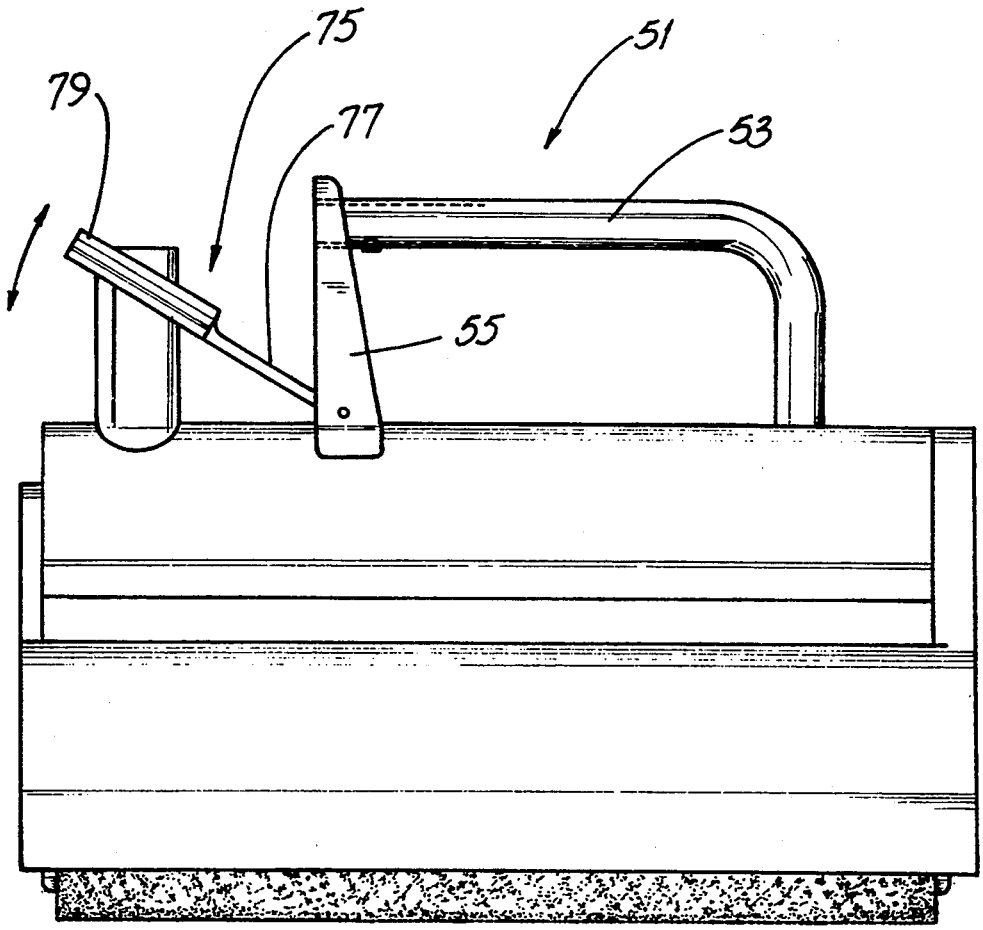
FIG. 7 is an elevation view of the lower part of the machine of FIG. 5 showing details of one embodiment of the handle mechanism. Certain surfaces are shown in dashed outline and the latching member and its latching bar are shown in the upward, latched position.
Figure 10:
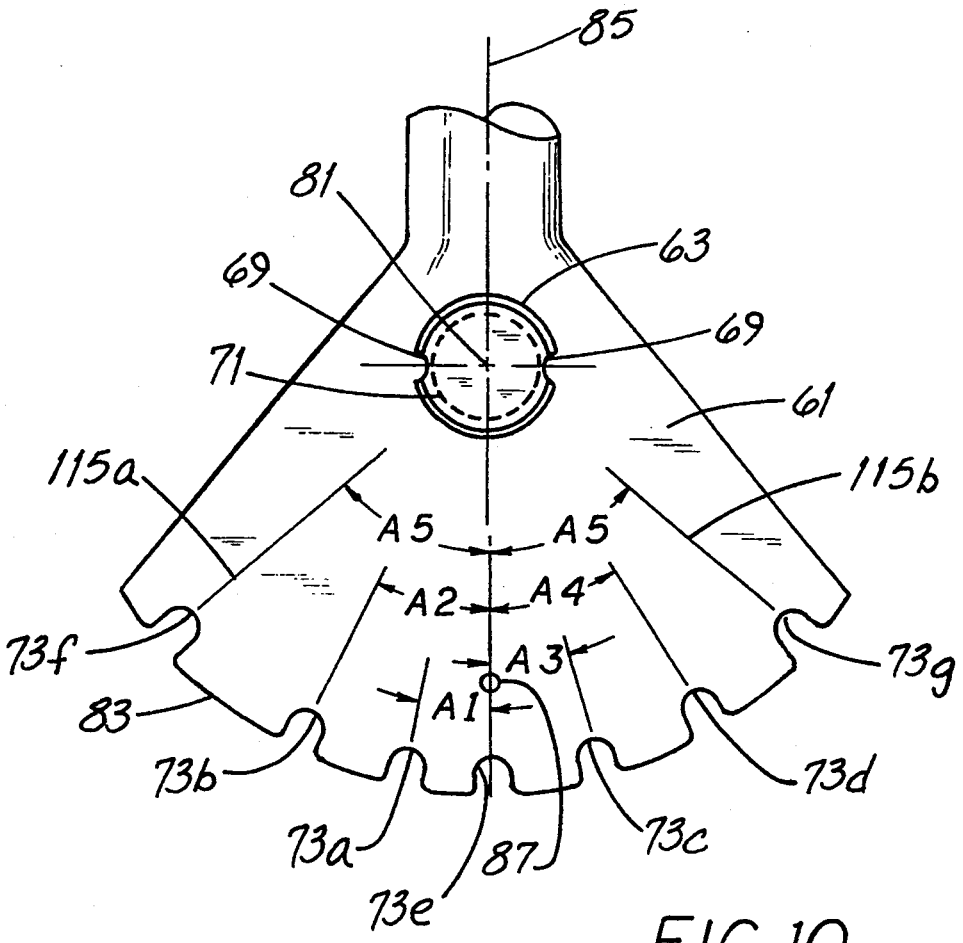
FIG. 10 is a view of the latching segment of the handle assembly of FIG. 8 taken along the viewing plane 10—10 thereof. Parts are broken away and a surface is shown in dashed outline.
Figure 11:
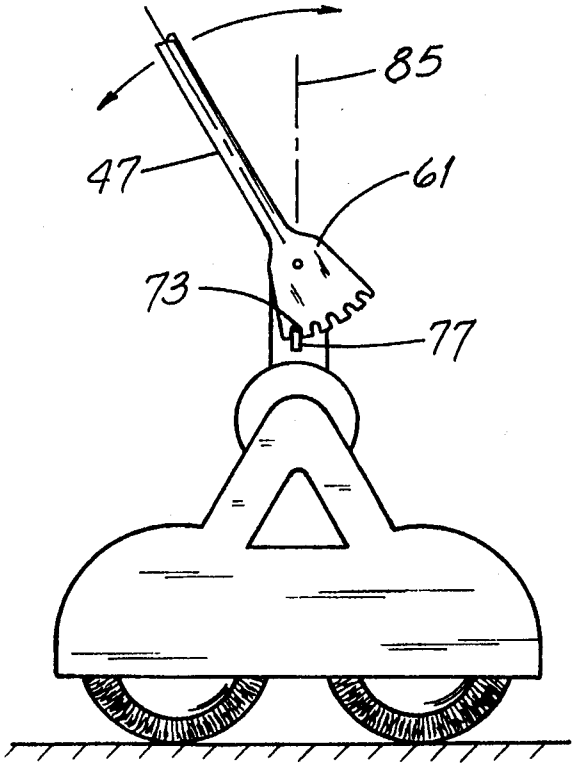

Referring particularly to FIGS. 7 and 10 and also to FIGS. 11 and 12, the latching segment 61 has at least one notch 73 formed in it and, as described below, several notches 73 are preferred. A latching member 75 has one end of a latching bar 77 mounted on the support 55 for pivoting movement up and down. The treadle 79 is attached to the other end of the bar 77 to move such bar 77 into and out of engagement with a notch 73. Such treadle 79 makes it easy to move the latching member 75 up or down with one's foot—little bending is required. And the handle assembly 57 is latched in a position when the bar 77 engages a notch 73 as exemplified by the depictions of FIGS. 11 and 12.

Figure 7A:
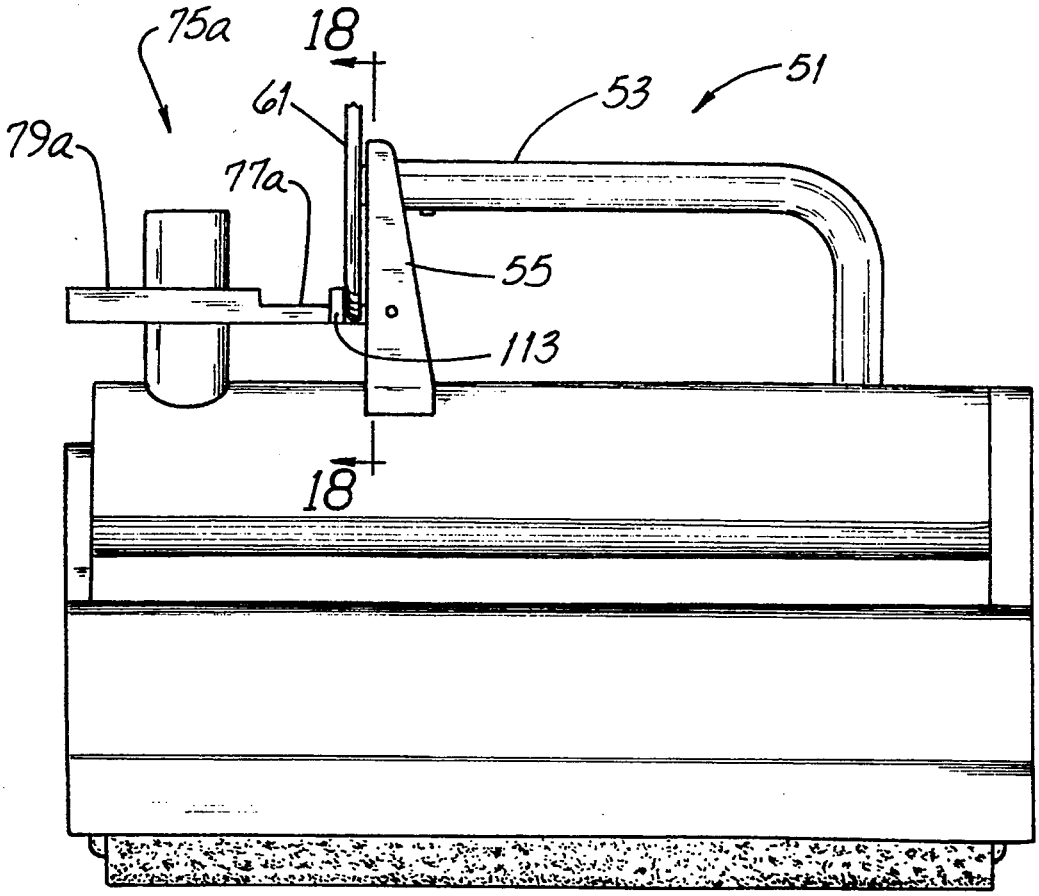
FIG. 7A is an elevation view of the lower part of the machine of FIG. 5 showing details of another embodiment of the handle mechanism. Parts are broken away and the latching member and its latching bar are shown in the upward, latched position.
Figure 7B:
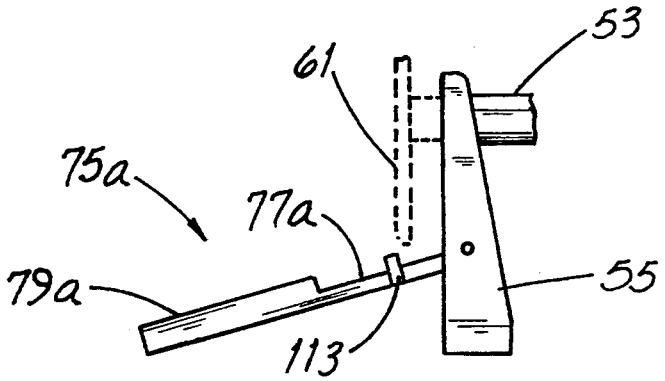
FIG. 7B is an elevation view of aspects of that part of the machine shown in FIG. 7A and illustrates the latching member and its latching bar in the downward, unlatched position. Parts are broken away and certain surfaces are shown in dashed outline.
Figure 8:
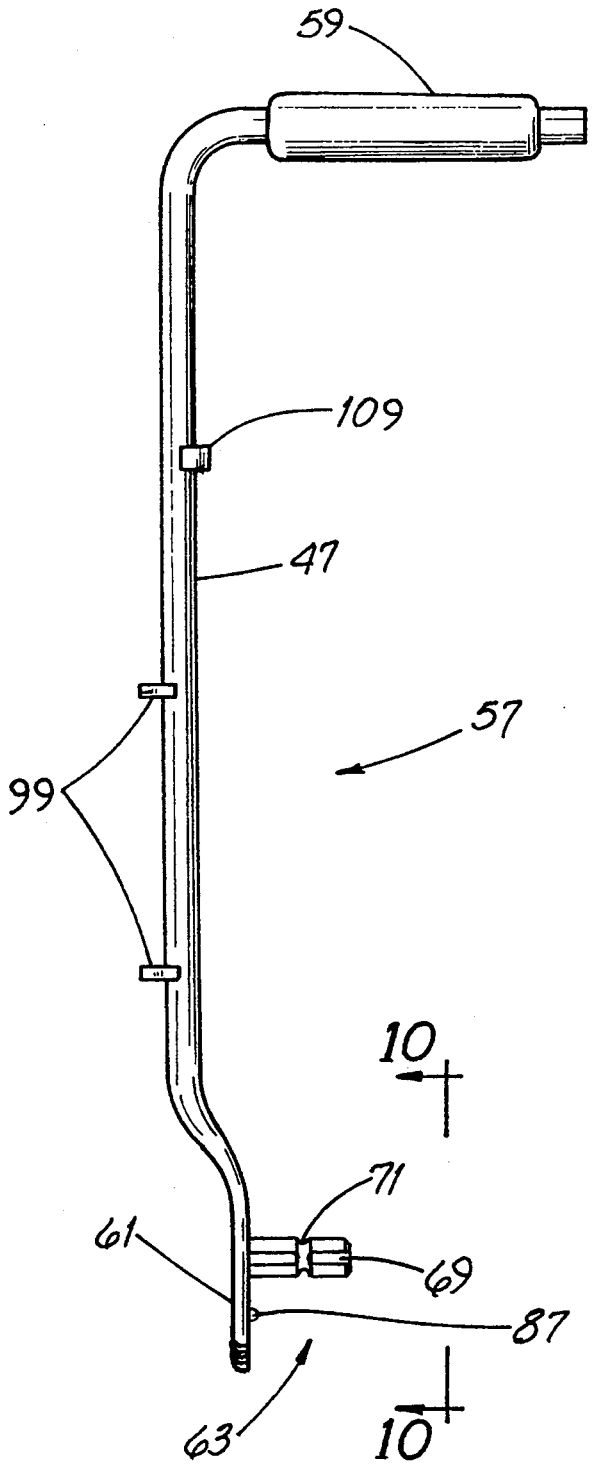
FIG. 8 is an elevation view of the handle assembly of the machine of FIG. 5.
Figure 9:
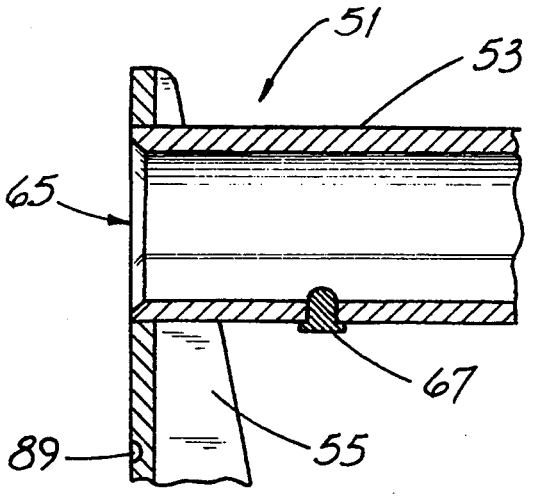
FIG. 9 is a cross-sectional view a portion of the handle mounting bracket of the machine of FIG. 5.

As shown in FIGS. 7A and 7B, a preferred latching bar **77*a* includes an upstanding, washer-like retention plate 113 overlapping and retentively bearing against the segment 61 when the bar 77*a* is in the upward position shown in FIG. 7A. The device 67 and the plate 113 are redundant to one another for retaining the assembly 57**.

When the bar **77*a* is in the lower position permitting "free swinging" articulated motion of the handle bar 47, the plate 113 may or may not be overlapped with the segment 61. If plate 113 is sufficiently high, it overlaps segment 61 even when the bar 77*a* is in the lower position. On the other hand, a shorter plate 113 will permit the handle 47 to be removed when the bar 77*a* is in the lower position. The lower edge 83 of the segment 61 is bevelled so that the plate 113 does not catch on the edge 83 as the bar 77*a*** is moved upward.

In further detail, the latching segment 61 has a pivot center 81 and a plurality of angularly spaced-apart notches 73 formed along the edge. The angle A1, A2, A3 or A4 at which a notch **73*a*, 73*b*, 73*c* or 73*d*, respectively, is displaced from the vertical centerline 85 is different for each notch 73. Therefore, the handle bar 47 is latched at a different angular position (with respect to, e.g., the carpet surface or to a horizontal plane) for each engagement of the latching bar 77 with a different notch 73**.

In a highly preferred embodiment, the latching segment 61 also includes at least one and preferably two outboard notches **73*f* and 73*g*, respectively. Each of such notches 73*f*, 73*g* is coincident with an axis 115*a* and 115*b*, respectively, and each axis 115 defines the same included angle A5 with the vertical centerline 85. The notches 73*f*, 73*g* permit the machine operator to position the handle bar 47 low and close to the carpet so that the machine 10** can be urged beneath a desk or other similar piece of furniture to clean the carpet thereunder.

Figure 12:
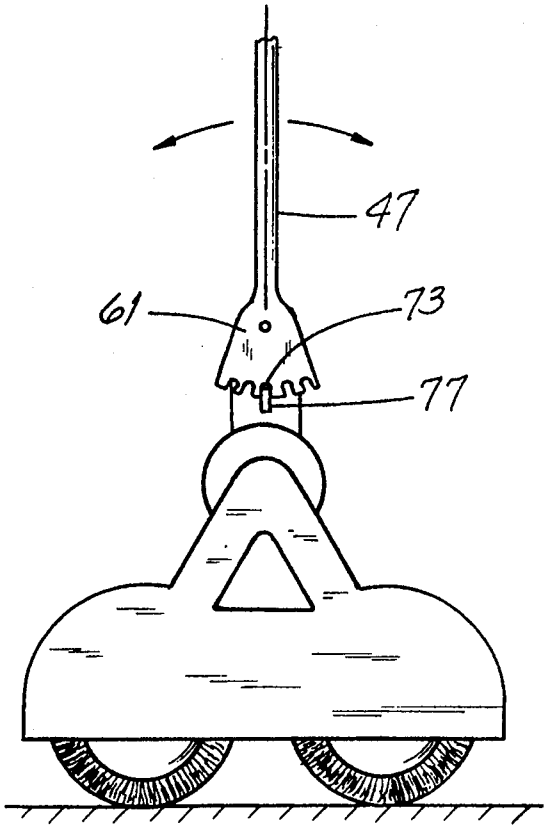
FIGS. 11 and 12 are side elevation views of the machine of FIG. 1 showing how the handle assembly may be latched in any of several positions. Parts are omitted for clarity and other parts are broken away.

And the handle bar 47 is latched at a vertical position as in FIG. 12 when the bar engages the center notch **73*e*. However, the machine 10 also includes an auxiliary detent nub 87 and a corresponding depression 89 into which the nub 87 seats to temporarily hold the handle bar 47 in the vertical position. Alternatively, the nub 87 can be mounted on the bracket 51 and the depression provided on the latching segment 61. Another type of detent is described below in connection with FIG. 18**.

It is to be appreciated that when the latching bar 77 is away from the segment 61 and out of engagement with any notch 73, the handle bar 47 is not retained in any angular position. Therefore, an operator can use the machine 10 with a free-swinging handle bar 47. (The detent nub 87 presents only a slight impediment to moving the handle bar 47 through the vertical position.)

Such latching arrangement is highly beneficial in at least four respects. One is that when the bar 77 engages a notch 73, the weight of the handle bar 47 and any apparatus mounted thereon, e.g., a vacuum pod 29, is well supported. There is no need for the operator to support such weight.

Another is that because the handle bar 47 can be latched at any of several positions (in addition to the vertical position), the gripping handle 59 can be located at any of several different heights above the carpet 33. An operator can select that handle height which is most comfortable for his or her stature and machine operating "style" and which is appropriate in view of constraints (e.g., walls, desks, etc.) preventing more typical machine use.

Yet another advantage involves the fact that if the handle bar 47 is lifted slightly while the bar 77 is engaged in a notch 73, the machine 10 is thereby tipped slightly forward. Its forward brush 17 engages the carpet 33 more aggressively than does the rearward brush 17 and as a consequence, the machine 10 is propelled forward largely under its own power. And when the handle bar 47 is depressed slightly and the machine 10 thereby tipped slightly rearward, the machine 10 is self-propelled rearward. Because of the new handle arrangement, the degree of manual effort required to urge the machine 10 across the carpet 33 is substantially reduced.

Still another benefit is that the operator has the choice of using the machine 10 with the handle bar 47 freely articulated or latched at a position. Each form of use has its advantages, depending upon how the machine 10 is then being used to clean carpet 33. In particular, when the handle bar 47 is latched at a position, the operator is better able to manipulate the gripping handle 59 and forcibly skew and/or tip the machine 10 to, e.g., change its direction of travel. It is during such occasions that the bristles 27 of a soft brush 17 are most likely to bend and the disc-like support members 39 are likely to be of most benefit.

Figure 14:
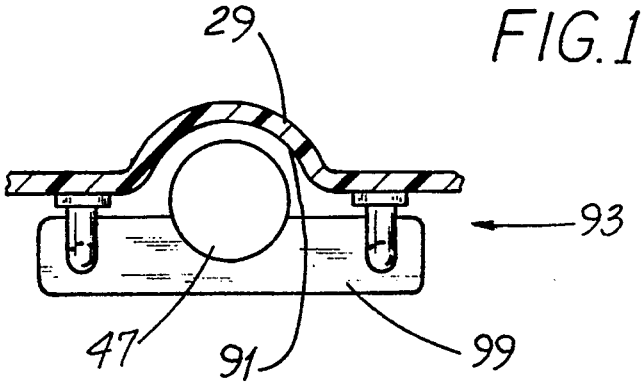
FIG. 14 is a top plan view, with parts broken away and other parts in section, of a portion of the pod and pod mounting arrangement of FIG. 13.
Figure 13:
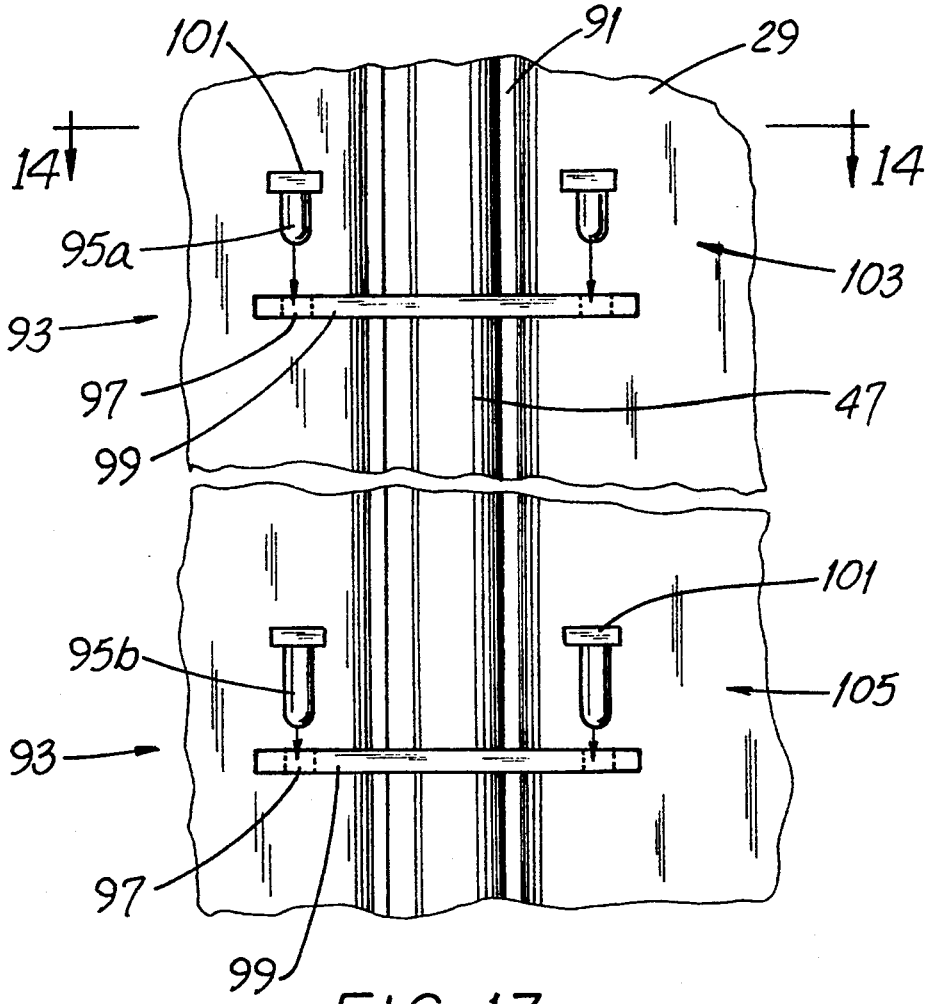
FIG. 13 is an elevation view, with parts broken away, of the mounting arrangement of the vacuum pod to the handle bar.

Referring again to FIGS. 5 and 6 and to FIGS. 13 and 14, a highly preferred machine 10 also includes a separately-powered vacuum "pod" 29 so that the machine 10 can retrieve dirt-laden granules after such granules have been brushed through the carpet 33 to clean the carpet fibers 35 strands. An exemplary pod 29 and the manner in which it is integrated with the machine are shown in U.S. Pat. No. 5,086,539 (Rench) which issued on Feb. 11, 1992, and is incorporated herein by reference.

The vacuum pod 29 has an elongate groove-like inward deformation 91 to accommodate and "nest" against the handle bar 47 and is detachably connected to such bar 47, preferably by a gudgeon-and-pintle mechanism 93, i.e., a mechanism having one or more pintie-like pins 95 engaging one or more gudgeon-like holes 97. In a specific arrangement, the handle bar 47 has a plurality of gudgeon-like supports 99 mounted thereon with holes 97 through the supports 99 to receive pins 95.

Each of the pintie-like pins 95, is mounted on an outwardly-extending tongue 101 and spaced away from the side of the pod 29. In a highly preferred arrangement, the pins 95 comprising the upper pin set 103 (as viewed in FIG. 13) are the same length one to another but differ in length from those pins **95*b* comprising the lower pin set 105 which are also the same length one to another. (In the exemplary arrangement of FIG. 13, the pins 95*b* of the lower set 105 are longer than those of the upper set 103**.)

In that way, one pin set 103 or 105 can be aligned with and inserted a short distance into its corresponding holes 97 and then the other pin set 105 or 103 aligned and inserted. One therefore need not try to align all four pins 95 simultaneously with their respective holes 97.

After the pins 95 are aligned with and inserted into their respective holes 97, the pod 29 is preferably secured in position so that it does not "jump up" and inadvertently disengage pins 95 from holes 97. While there are a number of ways to secure the pod 29, one way is to include a bale-like handle 107 which pivots about its attachment points and which is urged under a securing block 109 for pod retention.

Figure 15:
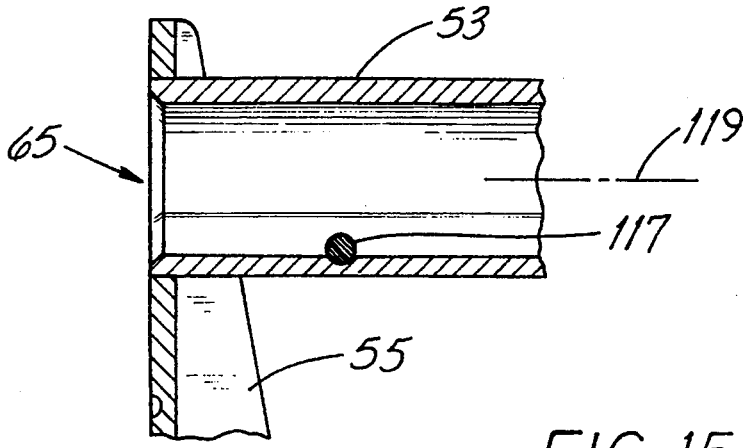
FIG. 15 is a cross-sectional view similar to that of FIG. 9 and showing an alternate arrangement for retaining the handle assembly on the machine.
Figure 16:
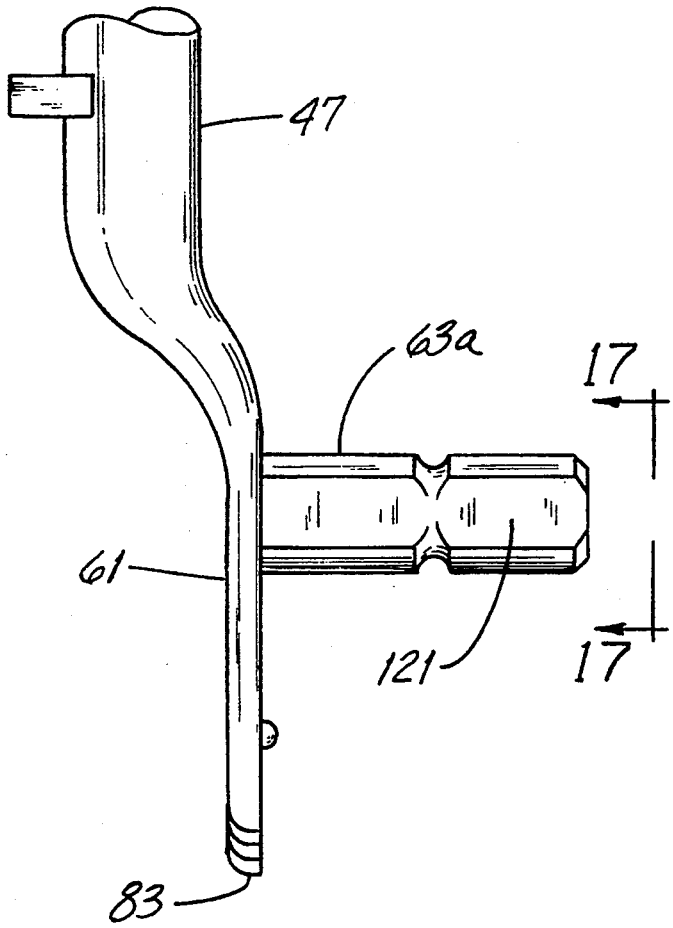
FIG. 16 is an elevation view similar to that of FIG. 8 showing an alternate configuration of the handle assembly mounting stud.
Figure 17:
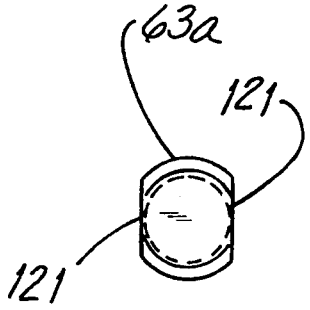
FIG. 17 is an end elevation view of the mounting stud of FIG. 16 taken along the viewing plane 17—17 thereof.

Referring next to FIGS. 15–17, an alternate way to retain the assembly 57 on the bracket 51 involves a retention pin 117 inserted laterally through the tube-like member 53. The pin is spaced from the pivot axis 119 and is generally at a right angle thereto. In this arrangement, the stud **63*a* includes only a retention groove 71—no slots 69 are required—and has one or two flat surfaces 121 formed thereon. When the handle bar 47 is positioned horizontally (to one or either side, depending upon the number of flat surfaces 121), the stud 63*a* "clears" the pin 117 and can be fully inserted into or withdrawn from the member 53. Like the device 67 and retention plate 113, the pin 117 and the plate 113 are redundant to one another for retaining the assembly 57**.

Figure 18:
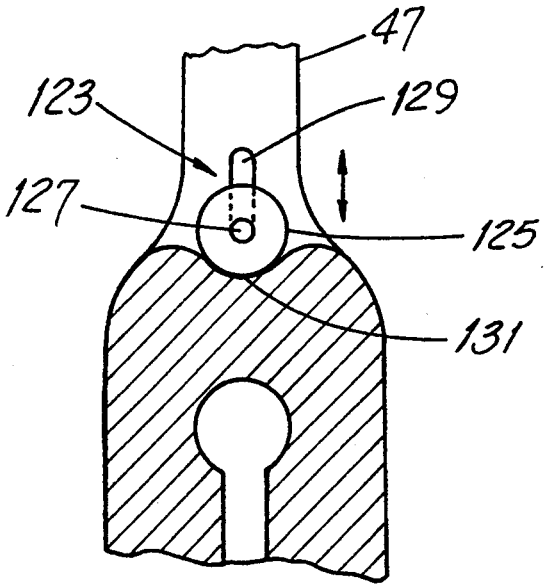
FIG. 18 is an end elevation view taken generally along the plane 18—18 of FIG. 7A (with parts broken away and other parts omitted for clarity) showing an alternate detent arrangement involving a spring-biased roller assembly.

Referring to FIG. 18, a roller assembly 123 may be used in place of the nub 87 and depression 89 to retain the handle bar 47 in the vertical position. The roller 125 is mounted to a pin 127 vertically movable in a groove 129 and is urged downward by a spring, not shown. The roller 125 engages a recess 131 in the top of the segment 61 for handle position retention.

After reviewing this specification and the drawing, it will be appreciated that the improvements offer a number of choices for machine configuration. That is, the machine 10 may be equipped with any one, some or all of the improvements mentioned above.

While the improvements have been described in connection with a few specific embodiments, it is to be understood clearly that these are by way of example and are not limiting.

We claim:

1. In a carpet cleaning machine having (a) a motor and (b) a pair of generally cylindrical carpet cleaning brushes driven by the motor and wherein each brush has bristles and a pair of brush ends, the improvement comprising:

a support member mounted on each end of each brush and contacting the carpet when bristles bend under the weight of the machine during use;

a handle assembly attached to the machine by a handle pivot mount and having (a) a handle axis and (b) a latching segment attached to the machine by a latching pivot mount, the segment having (a) at least one notch formed therein, and (b) a segment center axis extending through the latching pivot mount and being generally coextensive with the handle axis; and a latching bar mounted for spring-free, position-maintaining pivoting movement into and out of engagement with the notch.

2. The machine of claim 1 wherein each brush has a first diameter and the support members each have a second diameter less than the first diameter.

3. The machine of claim 2 wherein the second diameter is between about 70% and 95% of the first diameter.

4. The machine of claim 3 wherein the second diameter is between about 75% and 85% of the first diameter.

5. The machine of claim 1 wherein the brushes are first and second brushes having first and second brush axes of rotation, respectively, and wherein the support members of the first brush are generally disc-shaped and generally concentric to the first axis.

6. The machine of claim 5 wherein:

each support member has an outward portion; and, the outward portions are rounded to help prevent carpet fiber cutting when a support member contacts the carpet.

7. The machine of claim 1 including a machine shroud and wherein at least one support member contacts the carpet when bristles bend during machine use, whereby the shroud is substantially prevented from contacting the carpet.

8. The machine of claim 7 wherein each brush has a first diameter and each support member has a second diameter less than the first diameter.

9. The machine of claim 7 including:

a vacuum pod in air flow communication with the shroud for collecting particles removed from carpet by the brushes;

a handle assembly mounted to the machine and having an elongate handle bar; and, the vacuum pod is detachably connected to the handle bar by a gudgeon-and-pintle mechanism.

10. The machine of claim 9 wherein:

the handle bar has a plurality of gudgeon-like supports mounted thereon; and, the vacuum pod has a plurality of pintie-like pins and a separate pin engages each of the supports.

11. The machine of claim 1 wherein:

the handle assembly has an elongate handle bar;

the latching segment has an edge and a plurality of angularly spaced-apart notches formed along the edge;

the handle bar is latched at a different angular position for each engagement of the latching bar with a different notch;

one of the notches is a center notch coincident with the segment center axis; and the handle bar is latched at a vertical position when the latching bar engages the center notch.

12. The machine of claim 11 wherein the latching bar includes a retention member overlapping the latching segment when the handle bar is latched at a position, whereby the handle assembly is retained on the machine.

13. In a carpet cleaning machine having a handle assembly mounted thereon, the improvement wherein:

the handle assembly has a latching segment with at least one notch formed therein;

the machine has a latching bar mounted for spring-free pivoting movement into and out of engagement with the notch;

the latching bar includes a retention plate overlapping the latching segment when the latching bar engages the notch, whereby the handle assembly is latched in a position when the bar engages the notch and is prevented by the retention plate from being removed from the machine.

14. The machine of claim 13 wherein:

the handle assembly has an elongate handle bar;

the latching segment has (a) a segment center axis, (b) an edge and (c) a plurality of angularly spaced-apart notches formed along the edge;

one of the notches is coincident with the segment center axis;

the handle bar is latched at a different angular position for each engagement of the latching bar with a different notch; and the handle bar is substantially vertical when the latching bar engages that notch coincident with the segment center axis.

15. The machine of claim 13 including a shroud and first and second generally cylindrical carpet cleaning brushes supporting the machine, each brush having bristles and a pair of brush ends, and wherein the machine also includes:

a motor mounted above the shroud;

a support member mounted at each end of at least the first brush, at least one support member contacting the carpet when bristles of the first brush bend under the weight of the machine during use, whereby the shroud is substantially prevented from contacting the carpet and tearing carpet fibers.

16. The machine of claim 13 including:

a pair of powered, counter-revolving brushes;

a shroud over the brushes;

a vacuum pod in air flow communication with the shroud for collecting particles dislodged by the brushes;

a handle assembly mounted to the machine and having an elongate handle bar; and, the vacuum pod is detachably connected to the handle bar by a gudgeon-and-pintle mechanism.

17. The machine of claim 16 wherein:

the handle bar has at least one gudgeon-like support mounted thereon; and, the vacuum pod has a pintle-like pin engaging the support.

18. The machine of claim 17 wherein:

the handle bar has a plurality of gudgeon-like supports mounted thereon; and, the vacuum pod has a plurality of pintle-like pins and a separate pin engages each of the supports.

19. In a carpet cleaning machine having (a) a motor and (b) a pair of counter-revolving, generally cylindrical carpet cleaning brushes driven by the motor and wherein each brush has bristles and a pair of brush ends, the improvement wherein:

the machine has a support member mounted on each end of each brush and contacting the carpet when bristles bend under the weight of the machine during use;

each of the support members is made of a smooth, substantially rigid material and has an outer edge; and the outer edge is rounded to substantially avoid snagging carpet fiber.

* * * * *

UNITED STATES PATENT AND TRADEMARK OFFICE

CERTIFICATE OF CORRECTION

PATENT NO. : 5,404,609

DATED : April 11, 1995

INVENTOR(S) : Geoffrey B. Rench, Frank Jolly and David R. Sheppard

It is certified that error appears in the above-indentified patent and that said Letters Patent is hereby corrected as shown below:

In column 4, line 30, delete "pintie-like" and insert --pintle-like--.

In column 9, line 19, delete "pintie-like" and insert --pintle-like--.

In column 9, line 24, delete "pintie-like" and insert --pintle-like--.

In column 10, line 67, delete "pintie-like" and insert --pintle-like--.

Signed and Sealed this

Twentieth Day of June, 1995

*Attest:*

*Attesting Officer*

BRUCE LEHMAN

*Commissioner of Patents and Trademarks*